US007073418B2

(12) United States Patent
Kuo

(10) Patent No.: US 7,073,418 B2
(45) Date of Patent: Jul. 11, 2006

(54) STORAGE KIT FOR HEX KEYS

(76) Inventor: Tzu-Chi Kuo, No. 2, Lane 55, Li-Ching 1st St., Chi-Tu District, Keelung City (TW)

( * ) Notice: Subject to any disclaimer, the term of this patent is extended or adjusted under 35 U.S.C. 154(b) by 0 days.

(21) Appl. No.: 10/962,484

(22) Filed: Oct. 13, 2004

(65) Prior Publication Data

US 2006/0075857 A1 Apr. 13, 2006

(51) Int. Cl.
*B25G 1/08* (2006.01)
*B25B 23/16* (2006.01)

(52) U.S. Cl. ..... 81/490; 81/177.2

(58) Field of Classification Search ..... 81/177.2, 81/177.4, 438, 490
See application file for complete search history.

(56) References Cited

U.S. PATENT DOCUMENTS

| | | | | | |
|---|---|---|---|---|---|
| 2,409,613 | A * | 10/1946 | Brooks | 81/177.4 |
| 2,715,028 | A * | 8/1955 | Dossie | 81/177.4 |
| 4,043,230 | A * | 8/1977 | Scrivens | 81/177.2 |
| 4,767,006 | A * | 8/1988 | Wasem | 206/377 |
| 5,394,984 | A * | 3/1995 | Aiba | 206/377 |
| 5,592,859 | A * | 1/1997 | Johnson et al. | 81/177.4 |
| D415,946 | S * | 11/1999 | Tsai | D8/107 |
| 5,992,625 | A * | 11/1999 | Loiselle | 206/377 |
| 6,332,381 | B1 * | 12/2001 | Vasudeva | 81/177.2 |
| 6,508,156 | B1 * | 1/2003 | Wei | 81/490 |
| 6,510,766 | B1 * | 1/2003 | Lin | 81/177.4 |
| 6,598,503 | B1 * | 7/2003 | Cunningham | 81/177.4 |
| 6,675,678 | B1 * | 1/2004 | Liu | 81/177.2 |
| 2005/0011318 | A1 * | 1/2005 | Tsai | 81/177.2 |

* cited by examiner

*Primary Examiner*—David B. Thomas
(74) *Attorney, Agent, or Firm*—Bacon & Thomas, PLLC

(57) ABSTRACT

A storage kit for hex keys includes a barrel having one end provided with multiple blind holes each adapted with a channel to hold a hex key to help apply torque as a handle; and a cap holding hex keys together in the barrel to be pulled out of or inserted into the barrel at the same time; channel by; and another end of barrel having multiple insertion holes to store tips of other hand tools such as a screwdriver for the kit to function as the handle of the screwdriver.

1 Claim, 5 Drawing Sheets

STORAGE KIT FOR HEX KEYS

BACKGROUND OF THE INVENTION (a) Field of the Invention

The present invention is related to a storage kit for hex keys, and more particularly, to one collects multiple hex keys and allows itself a handle for a hex key and also for a screwdriver.

(b) Description of the Prior Art

Storage kits generally available in the market are essentially designed for each to store multiple keys by insertion. In use, the desired key is pulled out and incorporated with the kit for the kit to function as a handle for the hex key selected. Accordingly, other keys stored turn together with the active hex key in use making the operation somehow awkward, particularly so when the key must be held deep into a machine, since the handle usually will get stuck by other parts of a machine to prevent a smooth turning of the hex key.

Furthermore, value added is impossible for the storage kit of the prior art because that it is at its best provided for adaptation to a hex key by excluding any other hand tool, such as a screwdriver.

SUMMARY OF THE INVENTION

The primary purpose of the present invention is to provide a storage kit for hex keys that allows removal and insertion of multiple keys at the same time while the kit also functions as a handle when adapted with any of the hex keys to facilitate applying torque.

Another purpose of the present invention is to provide a storage kit for hex keys that allows insertion of alternative hand tool tip such as a screwdriver to use the kit as a handle for the screwdriver by providing multiple insertion holes on the other end in opposite to the end disposed with blind holes of the kit.

Another purpose yet of the present invention is to provide a storage kit for hex keys that allows adaptation to other types of hand tool tip such as a screwdriver by having a sleeve disposed at any of the insertion holes on the other end of the kit and a magnet contained in the sleeve to attract a tip of the screwdriver.

DETAILED DESCRIPTION OF THE PREFERRED EMBODIMENTS

Figure 1:
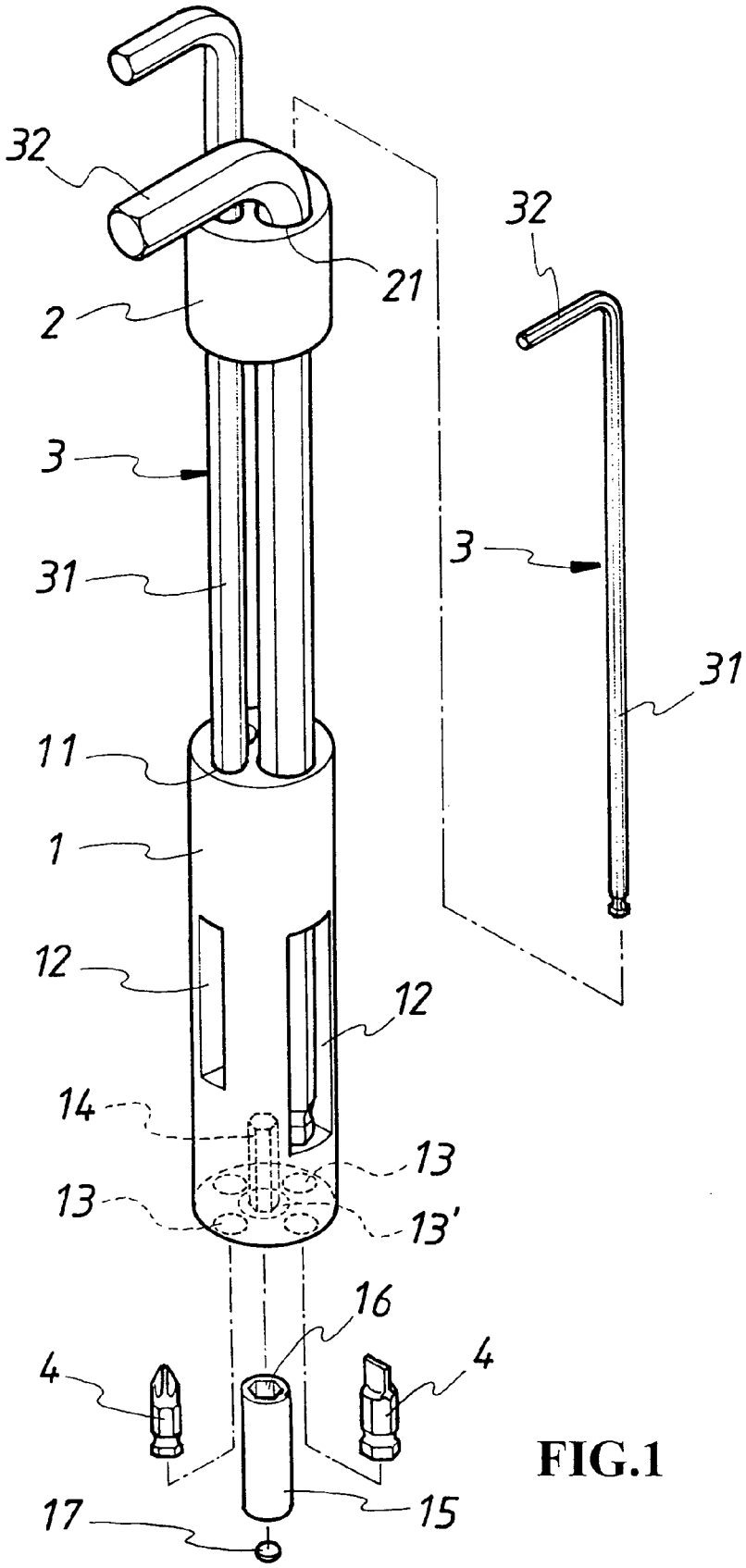
FIG. 1 is an exploded view of a local part of the present invention.
Figure 2:
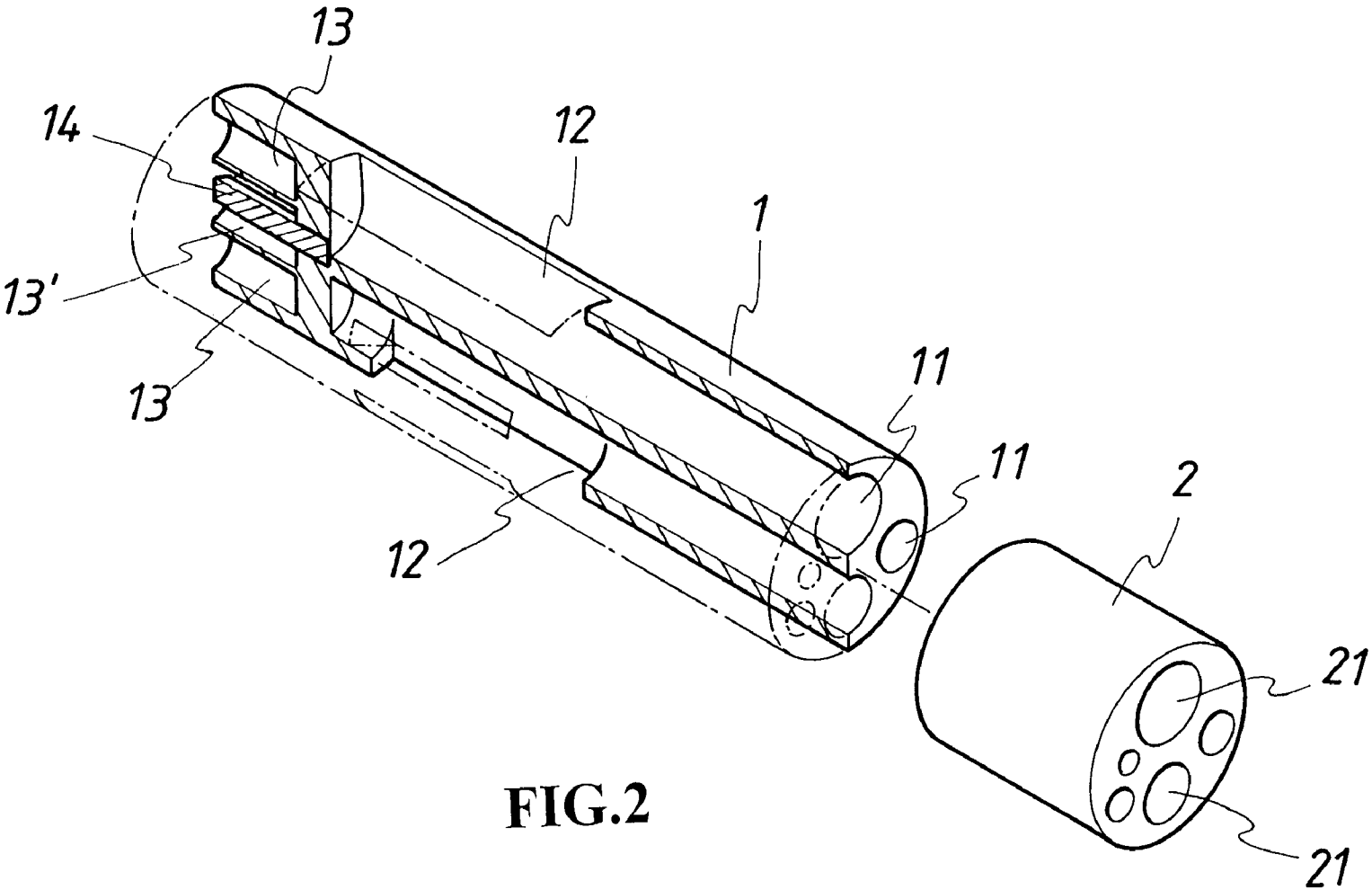
FIG. 2 is a perspective view showing a storage barrel adapted with a cap.
Figure 4:
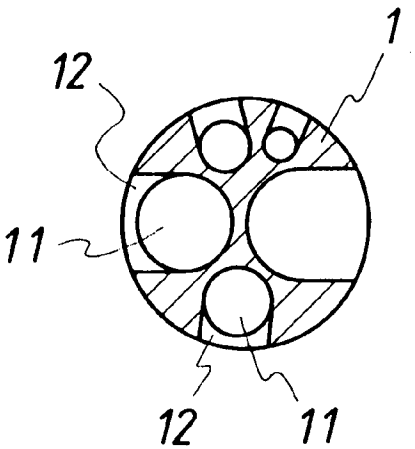
FIG. 4 is a sectional view of the present invention.

Referring to FIG. 1, a storage kit for hex keys of the present invention includes a barrel 1 and a removable cap 2 for storage of multiple hex keys 3 by insertion. Wherein, the barrel 1 also as illustrated in FIGS. 2, and 4, allows easy grip by a user. Multiple hex keys 3 are inserted into the barrel 1 for storage through with multiple blind holes 11 in identical or different diameter axially disposed on one end of the barrel 1, an open channel 12 is provided on the barrel 1 at where each key hex 3 is stored; and the barrel 1 also functions as an aid to help applying torque to turn the hex key 3.

As illustrated in FIG. 2, the cap 2 allows multiple hex keys 3 to be pulled out of or inserted into the barrel 1 synchronously so to keep the rest of those multiple hex keys 3 in neat and secured status when one of the hex keys 3 is pulled out, by providing multiple axial through holes 21 corresponding to the blind holes 11 either in number, location or size.

Figure 3:
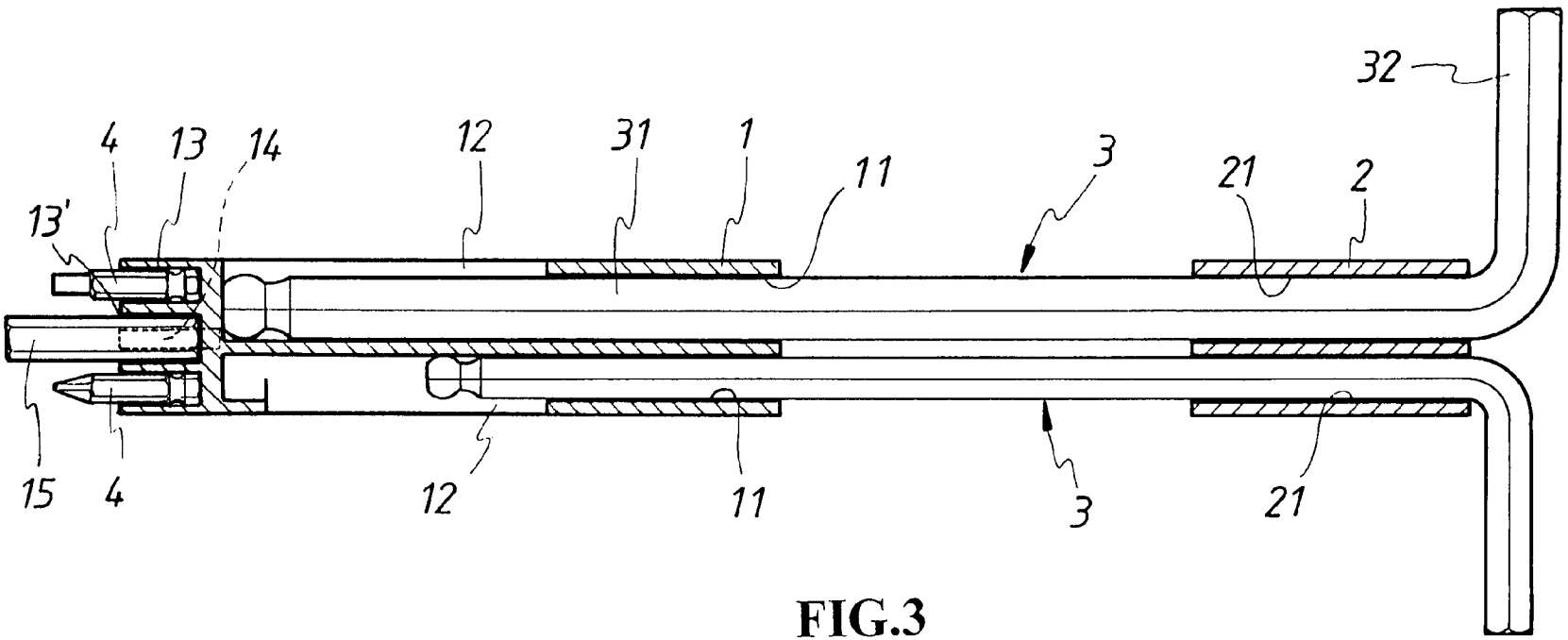
FIG. 3 is a cross-sectional view of the present invention with all hex keys stored in the barrel.

As illustrated in FIGS. 1 and 3, those multiple hex keys 3 are respectively inserted with their longer shanks 31 into their corresponding through holes 21 of the cap 2 and into those blind holes 11 provided on one end of the barrel 1 for the assembly of a storage kit of the present invention.

Figure 5:
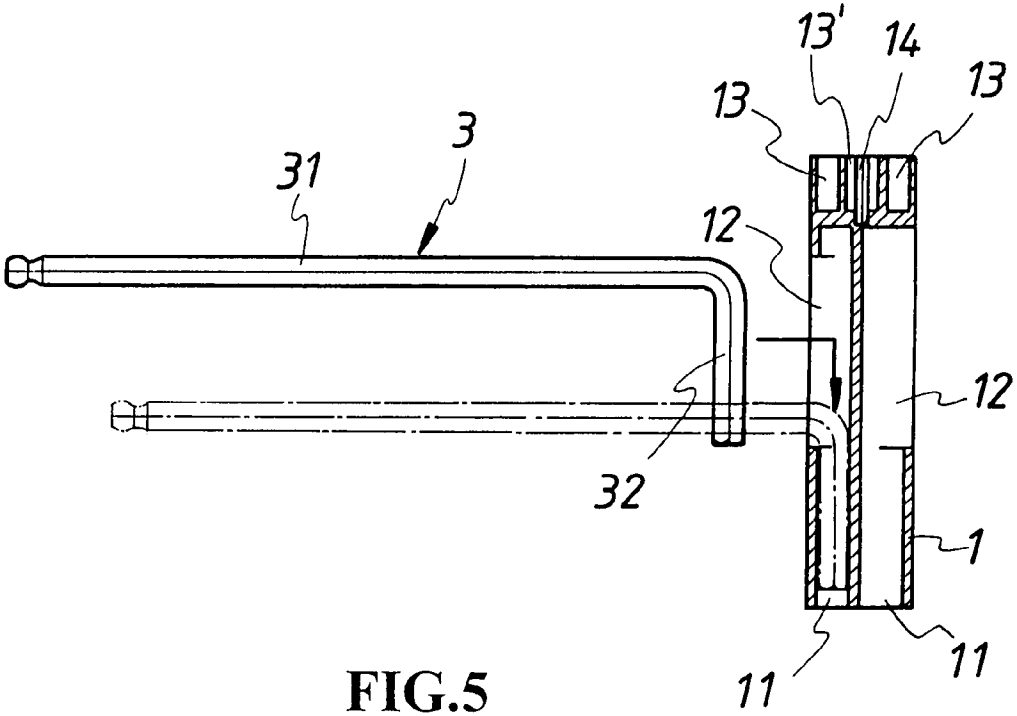
FIG. 5 is a schematic view showing an assembly of the present invention adapted with a hex key.

In use, the cap 2, together with all the hex keys 3, is pulled out of the barrel 1 at the same time to pick up one hex key 3 as desired while the rest of those multiple hex keys 3 stay with the cap 2 to prevent scattering of the multiple hex keys 3. The shorter shank 32 of the selected hex key 3 is placed into its matching channel 12 as illustrated in FIG. 5 and laterally inserted into the blind hole 11 for the barrel 1 and the longer shank 31 of the selected hex key 3 to form a T shape. Accordingly, while serving as a storage kit for those multiple hex keys 3, the barrel 1 when in use becomes a handle to help apply torque in operating the hex key 3.

With the cap 2 and the barrel 1 sharing the same construction, all the hex keys 3 can be fast and easily pulled out of the barrel 1 to eliminate the awkward operation with the presence of other hex keys 3 inserted in the blind hole 11 when the barrel 1 is used in conjunction with one hex key 3. Meanwhile the cap 2 holds the rest of the hex keys 3 together to prevent the rest of the hex keys from being scattered or being lost. Upon finishing a job, the selected hex key 3 is inserted into the cap 2 and the cap 2 is in turn inserted into the barrel 1 for a fast storage. Accordingly, the present invention provides benefits of preventing lose of any single hex key 3, and facilitating the collective removal and restoration of those multiple hex keys 3.

As illustrated in FIGS. 2, and 3, another end of the barrel 1 is provided with multiple insertion holes 13, an insertion hole 13' is selected as a minimum to be inserted with a hex stud 14 and the hex stud 14 can be attracted by a magnet. A sleeve 15 is then inserted into the insertion hole 13' to contain the hex stud 14. Both ends of the sleeve 15 is each disposed with a polygonal hole 16, and a magnet 17 is provided at the bottom of the polygonal hole 16 on a selected side of the sleeve 15. The hex stud 14, the sleeve 15 and a hand tool tip 4, e.g., a screwdriver, are connected to one another by the magnet 17 in the sleeve 15 for the barrel 1 and the hand tool tip 4 attracted by the sleeve 15 to become a screwdriver.

Figure 6:
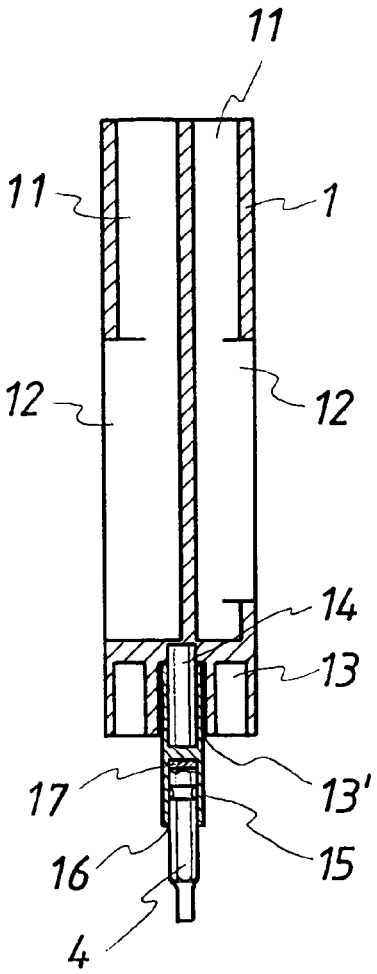
FIG. 6 is a schematic view showing that the present invention functions as a handle for a screwdriver.
Figure 7:
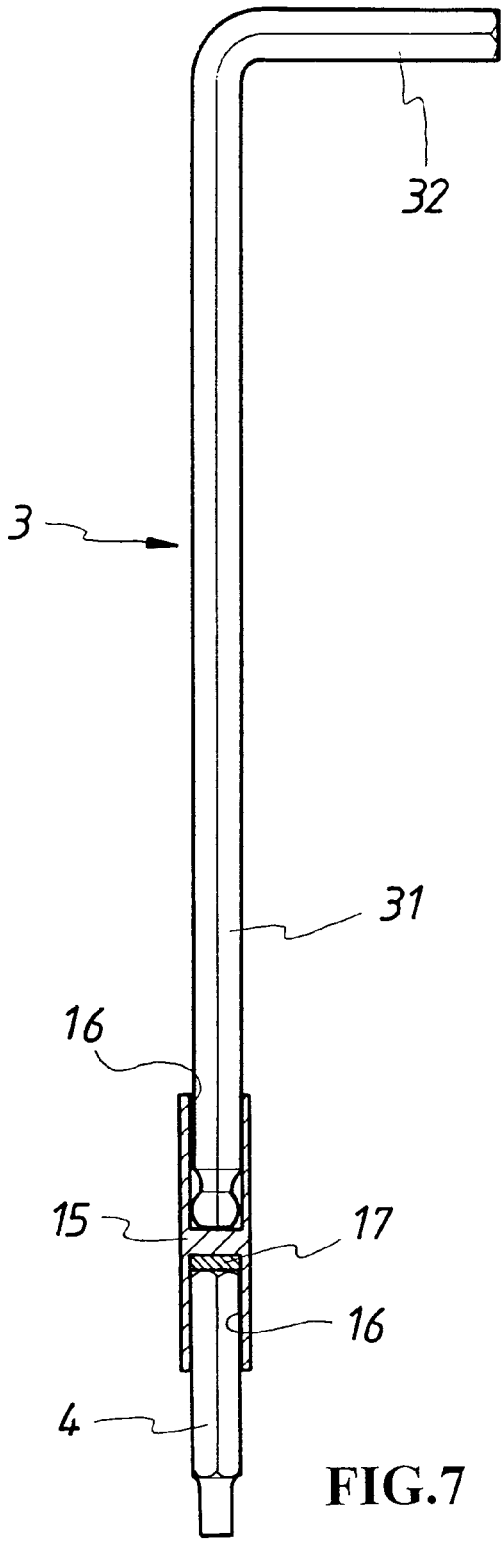
FIG. 7 is a schematic view showing another application of the present invention.

When those insertions holes 13, 13' and the sleeve 15 provided on the other end of the barrel 1 are applied as a handle of a screwdriver as illustrated in FIG. 6, a hand tool tip 4 desired is first pulled out of the insertion hole 13 and inserted into the sleeve 15 through the polygonal hole 16 to be attracted and secured in place by the magnet 17 to form an applicable screwdriver by the barrel 1 and the hand tool tip 4. As illustrated in 7, the longer shank 31 of a selected hex key 3 is inserted into the upper polygonal hole 16 of the sleeve 15 with the end of the longer shank 31 to be attracted and secured in place by the magnet 17; and finally, the hand tool tip 4 is inserted into the lower polygonal hole 16 of the sleeve 15 to become a screwdriver that allows sticking into a machine while the shorter shank 32 of the selected hex key 3 is inserted into the blind hole 11 through the channel 12 of the barrel 1 to make easier use of the screwdriver.

What is claimed is:

1. A storage kit for hex keys includes a barrel and a removable cap; the barrel being easy to grip and having one end provided with multiple axial blind holes each having a lateral open channel provided in the barrel to receive insertion of a shorter shank of a hex key; and the cap being provided with multiple axial through holes corresponding to the blind holes of the barrel, wherein a a long shank of a hex key may be inserted through a through hole of the cap to be further inserted into a corresponding blind hole of the barrel for storage.

* * * * *